United States Patent [19]

Lin

[11] Patent Number: 4,999,755

[45] Date of Patent: Mar. 12, 1991

[54] TUBE LIGHT

[76] Inventor: Tak-Huei Lin, P.O. Box 79-65, Taipei, Taiwan

[21] Appl. No.: 535,397

[22] Filed: Jun. 7, 1990

[51] Int. Cl.[5] ..... F21V 21/14

[52] U.S. Cl. ..... 362/250; 362/800; 439/110; 439/208; 439/211

[58] Field of Search ..... 362/250, 800; 439/110, 439/115, 207, 208, 211

[56] References Cited

U.S. PATENT DOCUMENTS

| | | | |
|---|---|---|---|
| 4,471,415 | 9/1984 | Larson et al. | 362/285 X |
| 4,667,277 | 5/1987 | Hanchar | 362/800 X |
| 4,709,307 | 11/1987 | Branom | 362/800 X |

*Primary Examiner*—Allen M. Ostrager

*Attorney, Agent, or Firm*—Lyon & Lyon

[57] ABSTRACT

A tube light comprises a tube having a continuous length, and a plurality of light units which conform to the inner configuration of the tube and can suitably be positioned anywhere in the tube. Conductor strips which are adapted to be connected with a power supply are disposed in parallel in the tube whereby the bulbs of the light units are engaged by contacting of the conductor strips with the contacts of the light units. The light tube is simple in structure and can be loaded with a suitable number of the light units in optional locations. In addition, the structure of the tube light is adapted for mass production. Further, the structure of the tube light may have a cover or clips, or be provided with wings on the light units, to facilitate securing the light units in the tube.

28 Claims, 13 Drawing Sheets

TUBE LIGHT

FIELD OF THE INVENTION

The present invention relates to a tube light, and particularly to a tube-light structure comprising a long tube and a plurality of light units which can be loaded into the tube.

BACKGROUND OF THE INVENTION

Conventionally, a decoration light-string is made by connecting, in series or in parallel, sockets of bulbs with wire conductors. In addition, the light-string can be inserted into a translucent plastic tube so as to form a tube light. However, the tube light made in this way is comparatively expensive, and connecting the bulbs with the wire is also time consuming. Furthermore, the work of pulling the light strings into the light tubes is not easy, which may also destroy the bulbs. When the bulbs are burned out, replacement of the bulbs becomes difficult. Also, the bulbs inside of the tube may not be moved or relocated, nor can the number of bulbs be increased or decreased. One prior example is the "Socket Structure of Decoration Lights" disclosed in Taiwanese Utility Model Patent No. 29873, which comprises bulbs, sockets, contacts and a holder. The sockets are disposed above the wires, and slots are provided in the sockets. The contacts are inserted into the slots and then go through the sockets, and are finally secured to the core of the wires. The holder is provided underneath the wires, where both sides of the holders extend upward so as to fasten tightly on the sockets, thereby securing the sockets on the wires.

SUMMARY OF THE INVENTION

The main object of the present invention is to provide an improved tube light structure.

Another object of the present invention is to provide a tube-light structure comprising a continuous length of tube and a plurality of light units which can be loaded into the tube.

The present invention, as typified by exemplary embodiments disclosed herein, is simple in structure and adapted for mass production. In addition, the combination of the tube and light units can be readily made by the purchaser, and the distance between the light units can be optionally adjusted according to the virtual need for decoration.

A further other object of the present invention is to provide a tube-light structure in which securing of the light units into the tube is accomplished by clips.

Another object of the present invention is to provide a tube-light structure, in which securing of the light units into the tube is accomplished by a cover.

Still another object of the present invention is to provide a tube-light structure, in which wings are provided at symmetrical sides of sockets of the light units so as to hold the light units on the tube.

Generally speaking, the present invention comprises a continuous length of tube in which continuous conductor strips are provided in parallel, and a plurality of the light units, each of which conforms with the configuration of the t can be loaded into the tube in a suitable tightness. The units are provided with contacts which keep in electrical with the conductor strips when loaded in the tube.

DESCRIPTION OF PREFERRED EMBODIMENTS OF THE INVENTION

Figure 1:
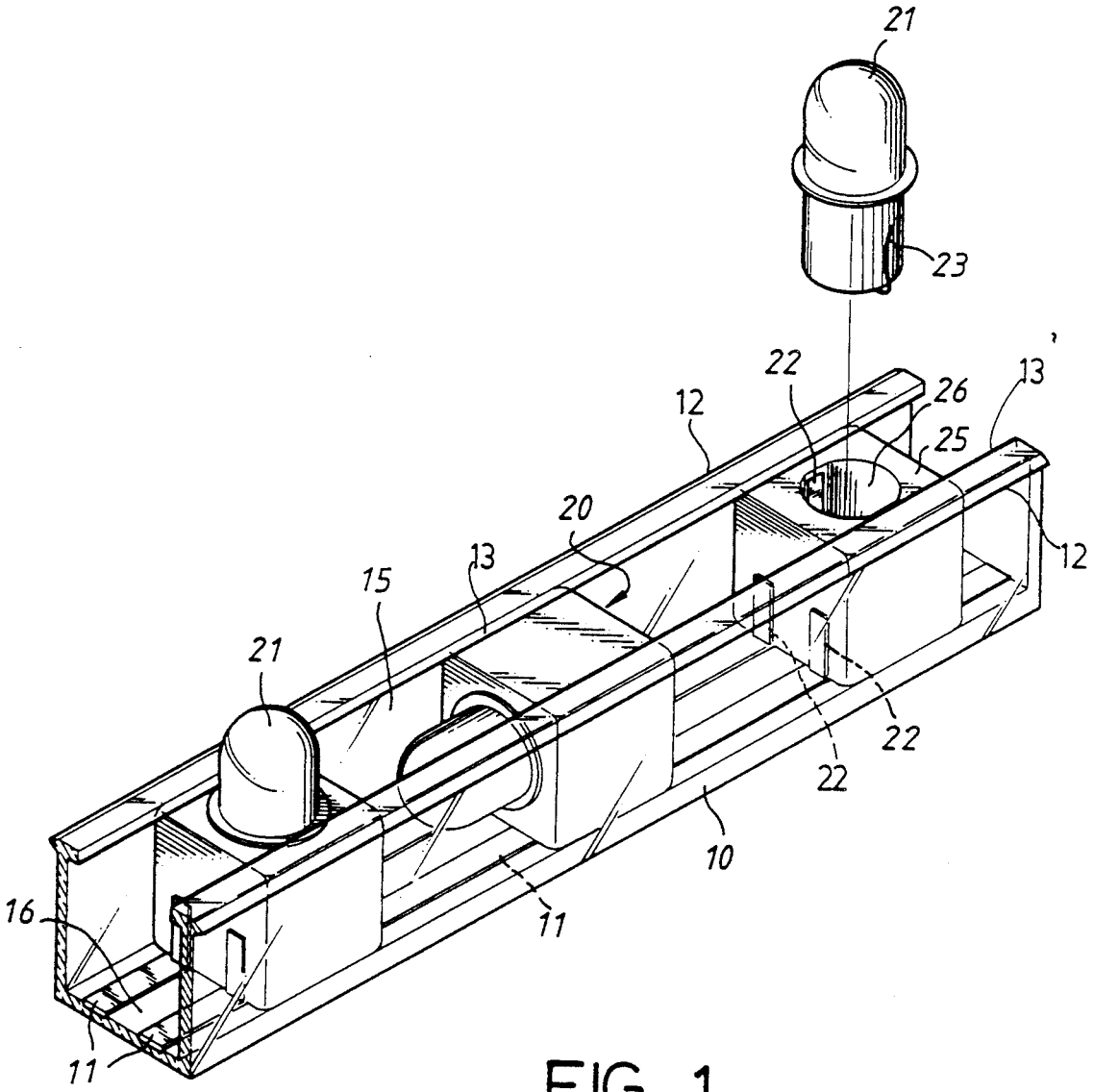
FIG. 1 is a perspective view showing a first embodiment of the invention.
Figure 1A:
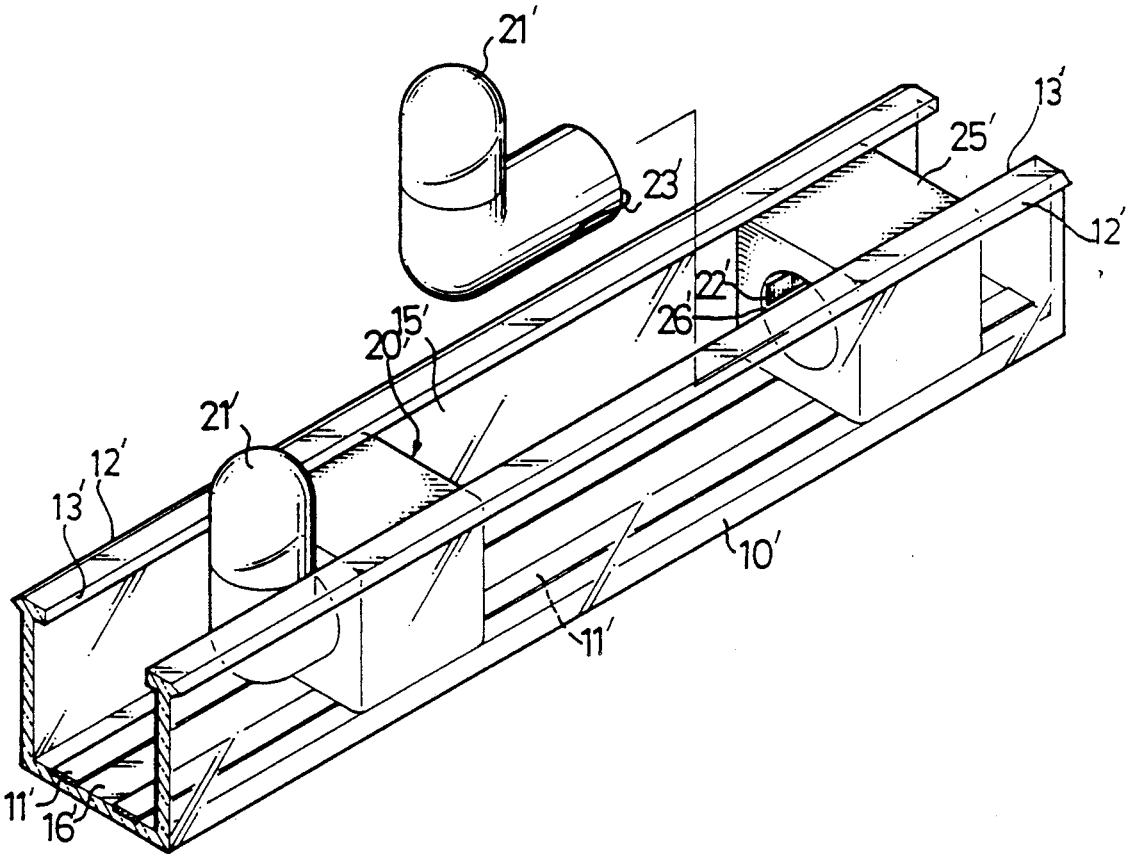
FIG. 1A shows a modification of the first embodiment, wherein the bulb is changed to an L-configuration

The construction and function of the present invention will be described, by referring to the drawings, as follows.

Figure 2:
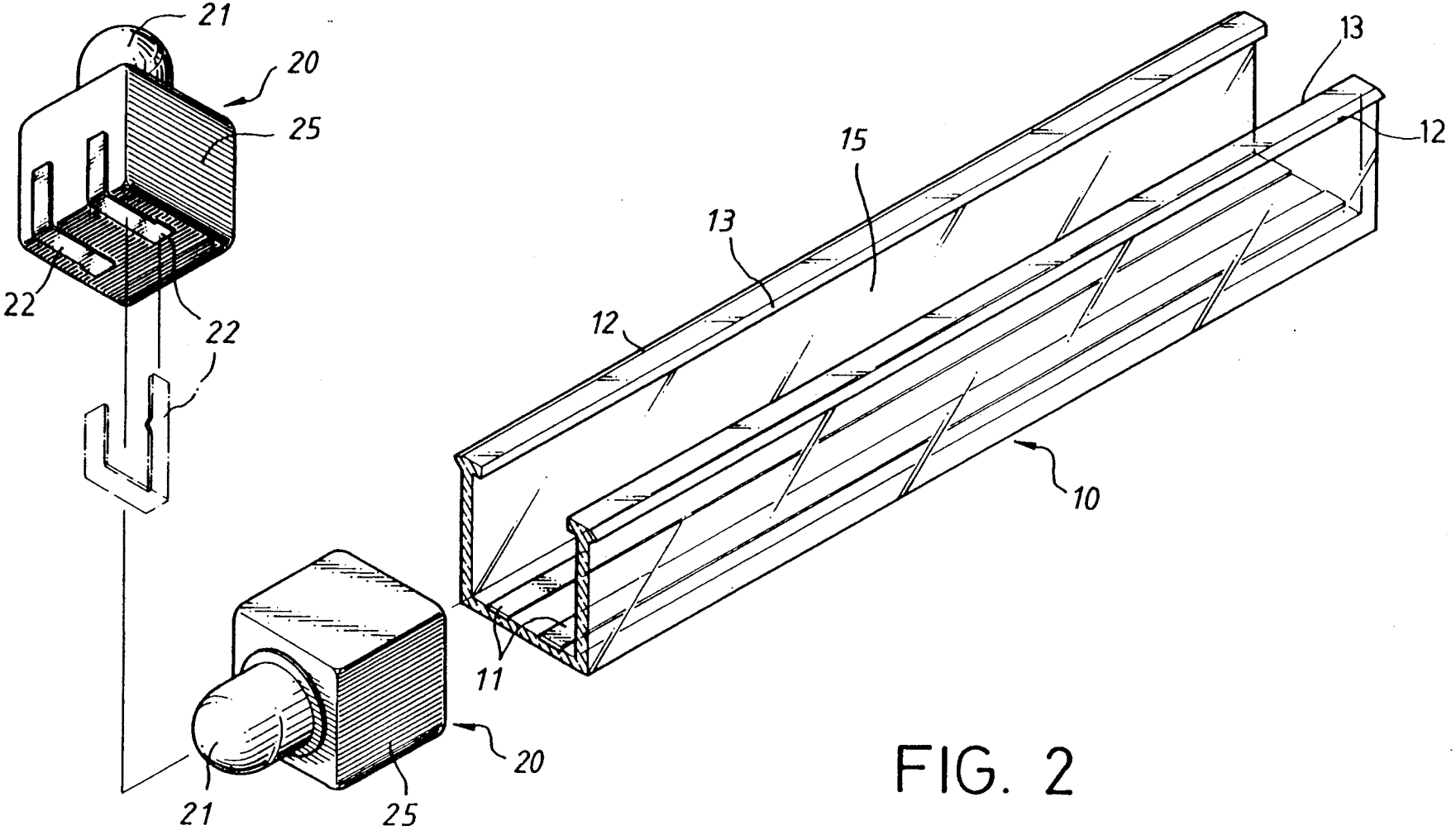
FIG. 2 is an exploded view of the invention.
Figure 3:
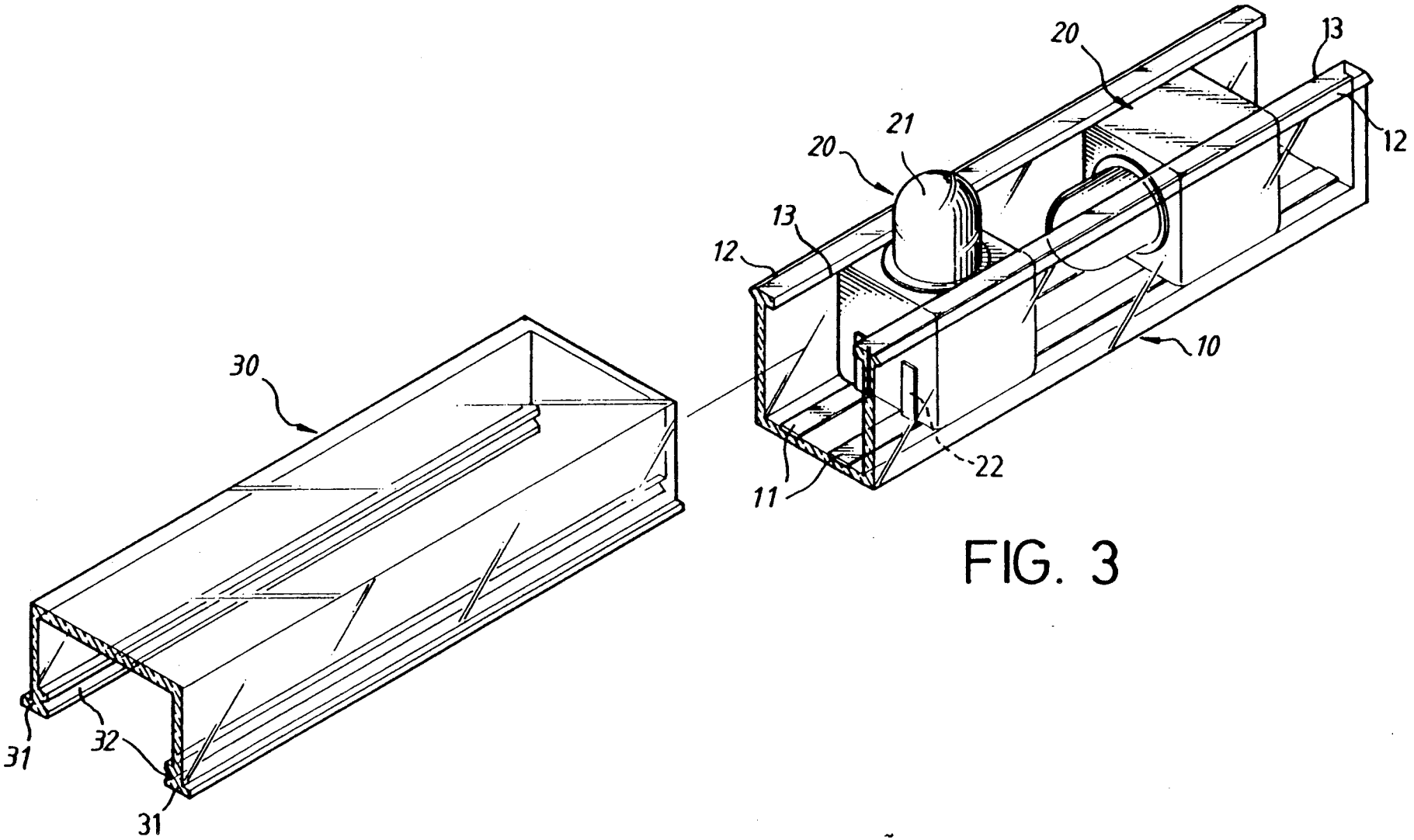
FIG. 3 shows the invention with a cover.

As shown in FIGS. 1, 2, and 3, the tube light according to the present invention comprises a tube 10 and a plurality of light units 20. The tube 10 is formed by a length of continuous tube-like material. The cross-section of the tube 10 may be of square, rectangular of other suitable shape. In this embodiment, the tube 10 preferably is a plastic, translucent and straight continuous hollow tube having a square cross-section as shown. The top of the tube 10 is formed with a continuous opening 15 having the same width along the length of the tube as defined by edges 13. Opposing the edges 13 are V-shaped edges 12 extending out from the sides of the tube 10. Two parallel and continuous electrical conductor strips 11 are provided, by gluing or inserting, at the bottom 16 of the tube 10. The conductor strips 11 preferably are made of copper sheets of electrically conductive metal, where the conductor strips 11 maintain a certain distance from each other, and the conductor strips 11 are to be connected with an electrical power source.

The light unit 20 comprises a bulb 21, contacts 22 and a socket 25. The socket 25 is molded from insulating material, such as any suitable plastic, inside of which an opening 26 is provided for accommodating the bulb 21. The socket 25 may be in the shape of a cube, rectangular parallelepiped, or other configuration. However, it should noted that the configuration of the socket 25 should comply with the inside configuration of the tube 10.

In the present embodiment of the invention, the socket 25 is made as a cube so as to conform to the hollow square cross-section of the tube 10. The clearance between the tube 10 and socket 25 is only provided for the purpose that both can maintain appropriate tightness when fitted together, for which the spring nature of the contacts 22 also assist. The opening 26 in the socket 25 conforms to the configuration of the bulb 21, and appropriate tightness is necessary when the bulb 21 is fitted into the opening 26. The contacts 22 are disposed along the side walls of the opening 26, and extend out of the bottom of the socket 25 as shown in the drawing, and rest on the outside walls of the socket 25, so that the contacts 22 at the side walls of the opening 26 can be in touch with the leads 23 of the bulb 21, while the contacts 22 outside the wall of the socket 25 can be in touch with the parallel conductor strips 11. Therefore, whether the socket 25 is put into the tube 10 upright or laterally, the contacts 22 always keep in touch with the conductor strips 11. In addition, the conductor strips 11 may comprise more than two parallel strips, to which the span of the contacts 22 should also conform, so that timing for lighting the bulbs 21 can be differentiated and that the decorating effect of the invention can be enhanced.

To enable a desired length of the tube 10 to be provided, translucent plastic blocks having the same cross section as that of the inside configuration of the hollow tube 10 can be provided to fit, physically and electrically join, the adjacent tubes 10 from both sides of the blocks. When the light units 20 are already loaded into the tube 10, a translucent plastic cover 30 as seen in FIG. 3 can be used to fit over the tube 10. Provision of the cover 30 is not essential; however, in case the present invention is to be installed outdoors, the cover 30 becomes desirable or necessary for prevention of moisture and rain. The width of the cover 30 should comply with that of the tube 10. Flanges 31 and V-shaped grooves 32 are provided at the bottom of the tube 10, such that the V-shaped grooves 32 can engage the V-shaped edges 12 of the tube 10.

Figure 4:
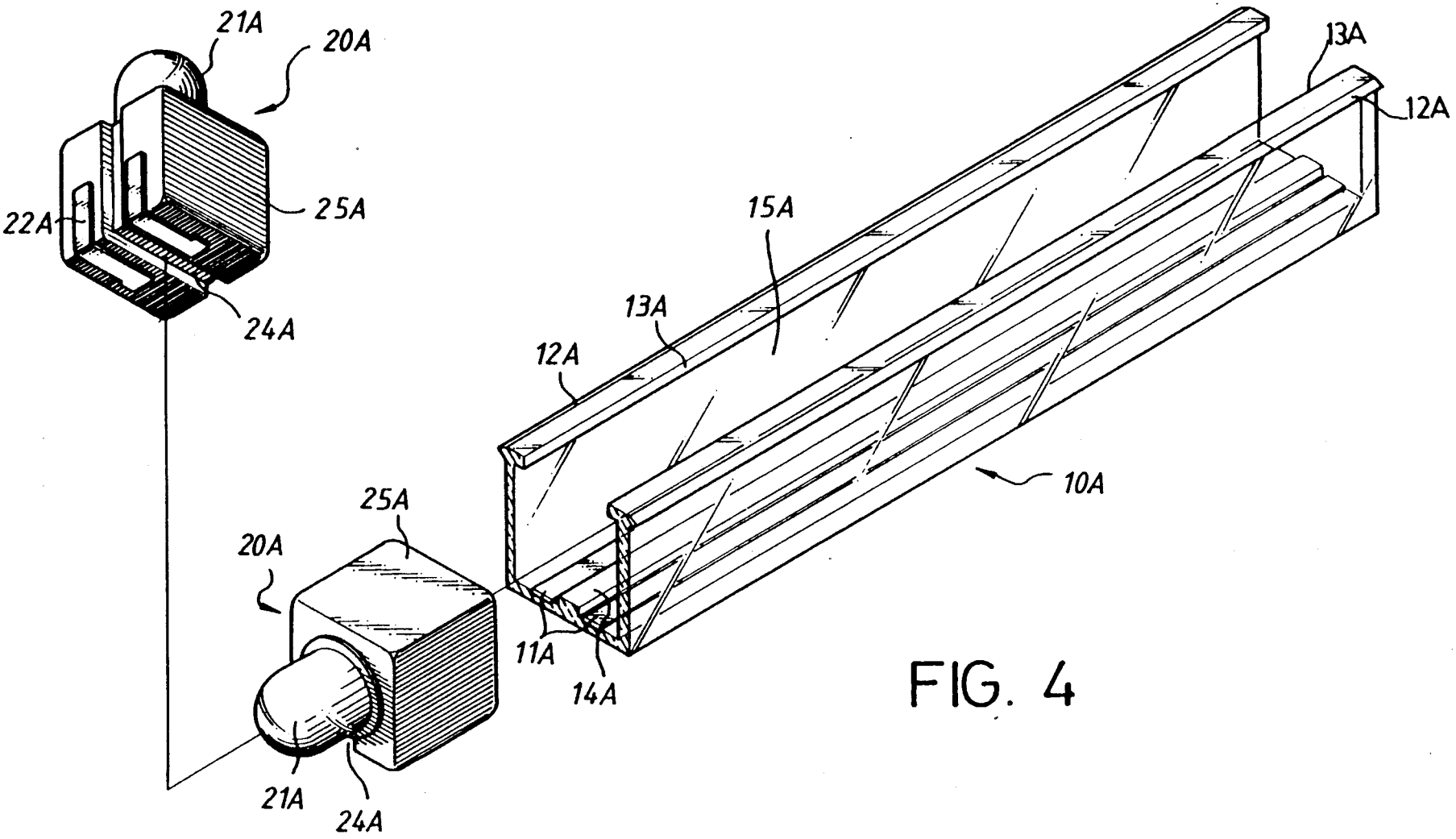
FIG. 4 shows a second embodiment of the invention.

Further referring to the second embodiment of the present invention as shown in FIG. 4, the structure of the components in this embodiment is generally the same as that of the embodiment shown in FIGS. 1 to 3; however, an "A" is added after the reference numerals so as to distinguish therebetween. The only difference between the second embodiment and the foregoing first embodiment is a longitudinal protrusion 14A provided along the bottom of the tube 10A and between the two conductor strips 11A. The protrusion 14A is substantially disposed at the center of the bottom of the tube 10A. Likewise, the adjacent sides of the socket 25A are provided with communicating grooves 24A of which the width corresponds to that of the protrusion 14A. As a result, the grooves 24A will engage with the protrusion 14A and ensure proper orientation when the light units 20A (sockets 25A) are loaded into the tube 10A.

Figure 5:
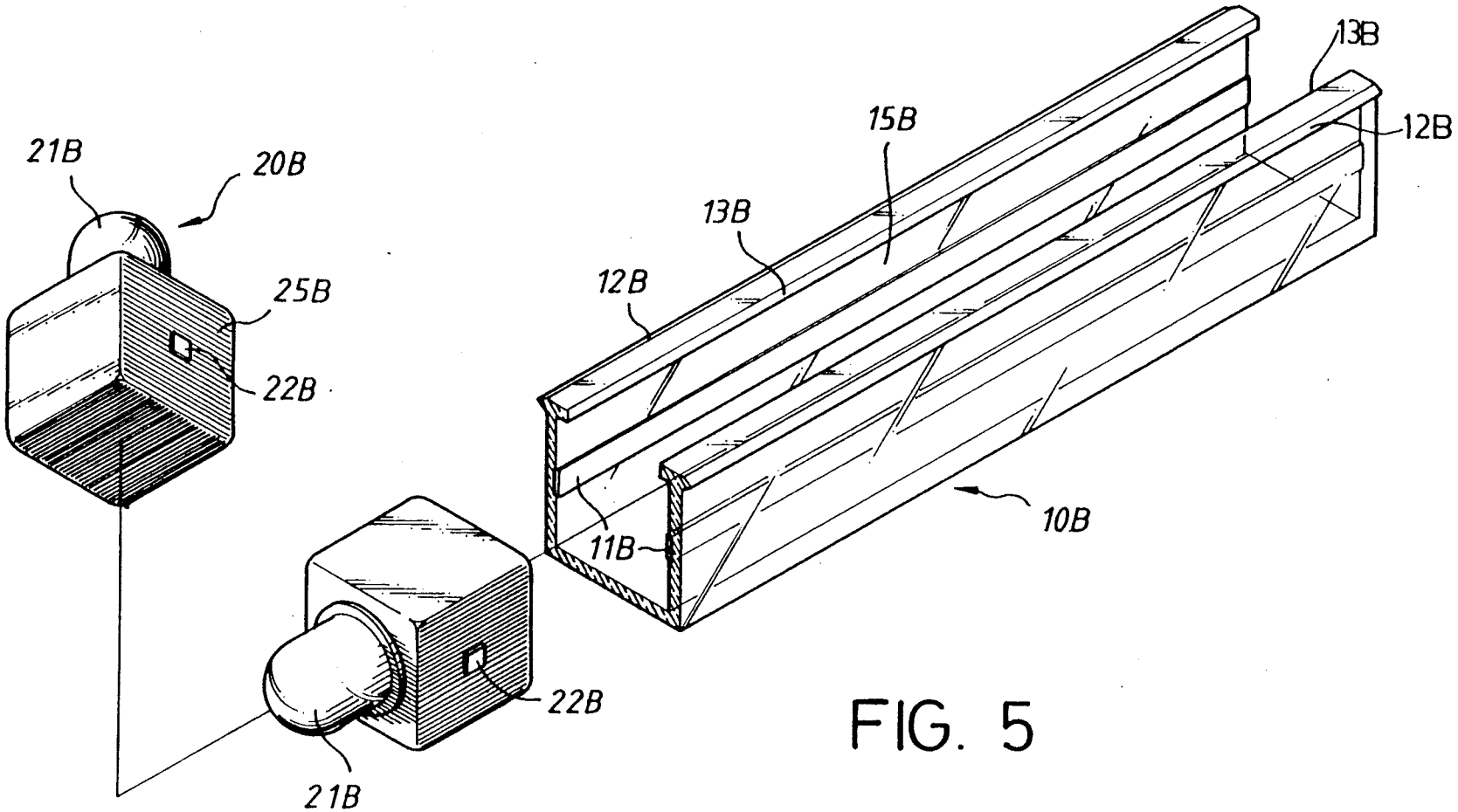
FIG. 5 shows a third embodiment of the invention.

The embodiment shown in FIG. 5 differs from the first embodiment in that the conductor strips **11*b* are provided respectively on the opposed side walls of the tube 10*b*, and substantially extend along the center of the height of the side walls longitudinally. The contacts 22*b* of the light unit 20B extend outward from inside of the socket 25B** and are bent upward along the external walls.

Generally, the contacts 22B are disposed in the middle of the side walls of the socket 25B. On the side walls of the socket 25B corresponding to the contacts 22B recesses are provided for receiving the contacts 22B when the socket 25B is loaded into the tube **10*b* and the contacts 22B** are pressed by the fingers.

Figures 6, 7:
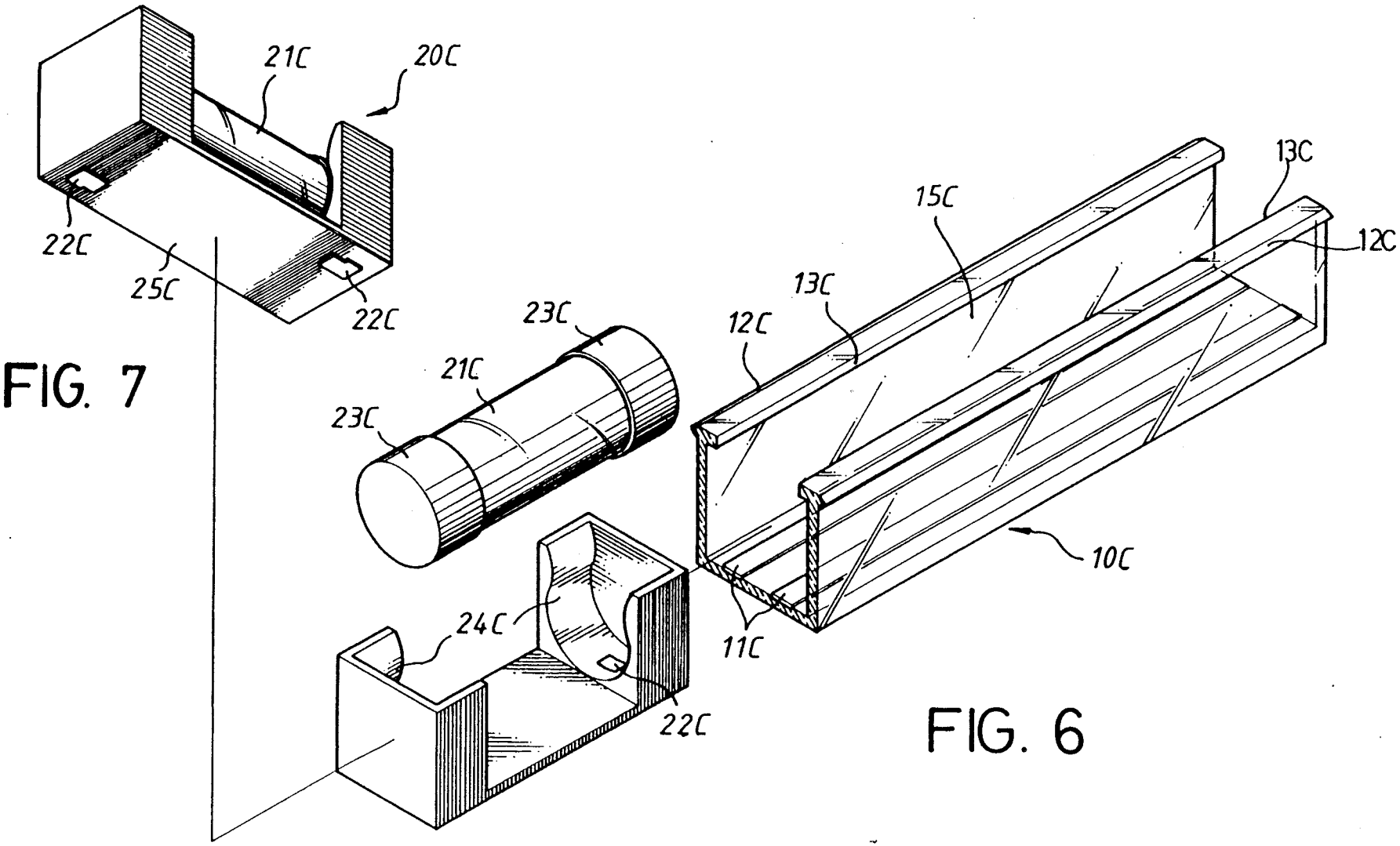
FIG. 6 shows a fourth embodiment of the invention.
FIG. 7 shows the bottom of a light unit of the fourth embodiment.

The embodiment shown in FIGS. 6 and 7 is a light unit 20C formed as a hollow rectangular parallelepiped as shown in FIG. 6. The socket 25C is molded from insulating material wherein the interior of each end has a recess 24C for holding the contacting ends 23C of the bulb 21C.

Contacts 22C ar provided at the ends of the socket 25 respectively and extend to the inside of the recess 24C and underneath the socket 25C. The contacts 22C are adjacent to the right and left sides of the socket 25C so as to be in touch with the conductor strips 11C of the tube 10C.

Figure 8:
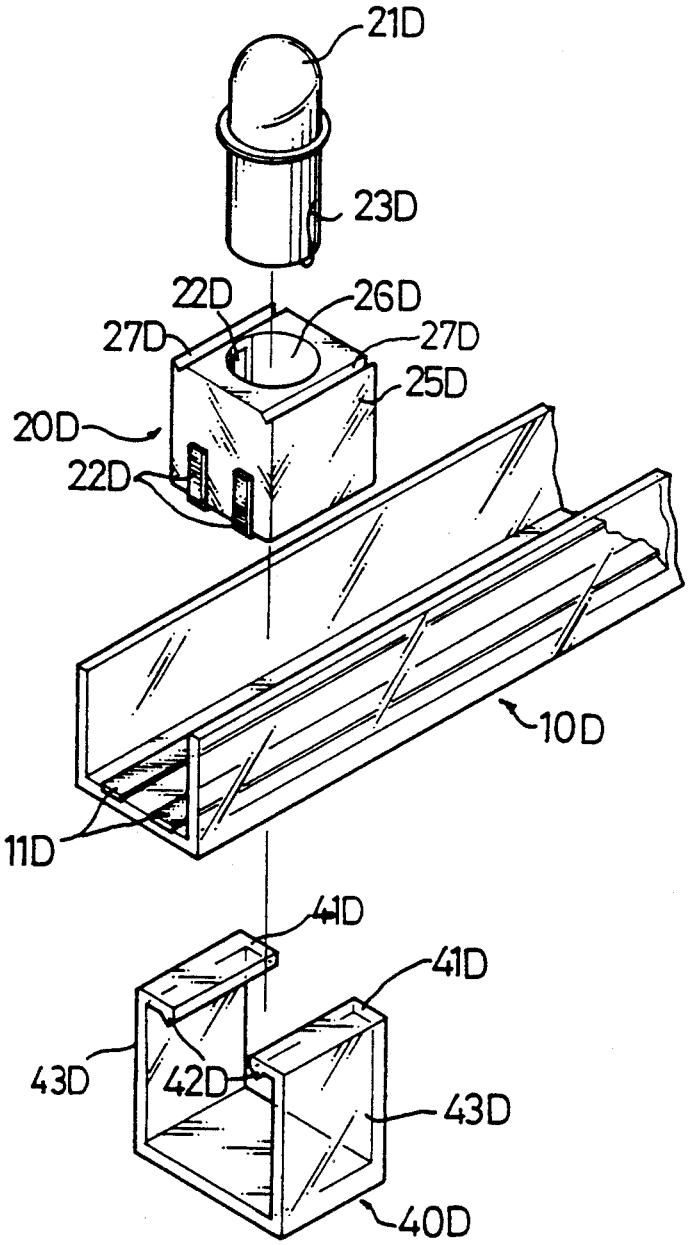
FIG. 8 shows an exploded view of a fifth embodiment of the invention.
Figure 10:
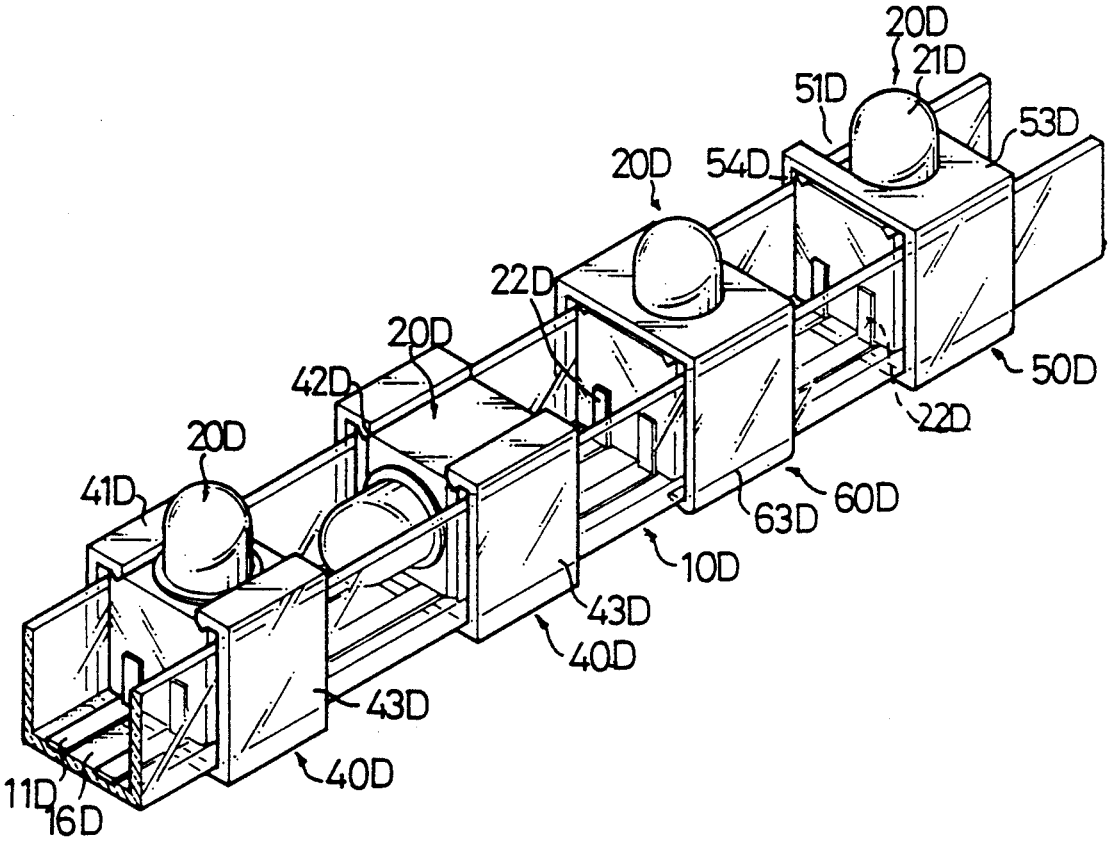
FIG. 10 shows an assembled arrangement of FIG. 9.

FIG. 8, shows a fifth embodiment according to the present invention, wherein the socket 25 is provided with V-shaped grooves 27D at the top side edges. Clips 40D are provided for securing the light units 20D on the tube 10D as shown in FIG. 10. The inner span between the two sides 43D of the clip 40D corresponds to the outer span of the two sides of the tube 10D. Each of the two sides 43D is provided with an inward flange 41D, which at the end of the flange 41D a fastening edge 42D corresponding to the V-groove 27D is provided.

Figure 9:
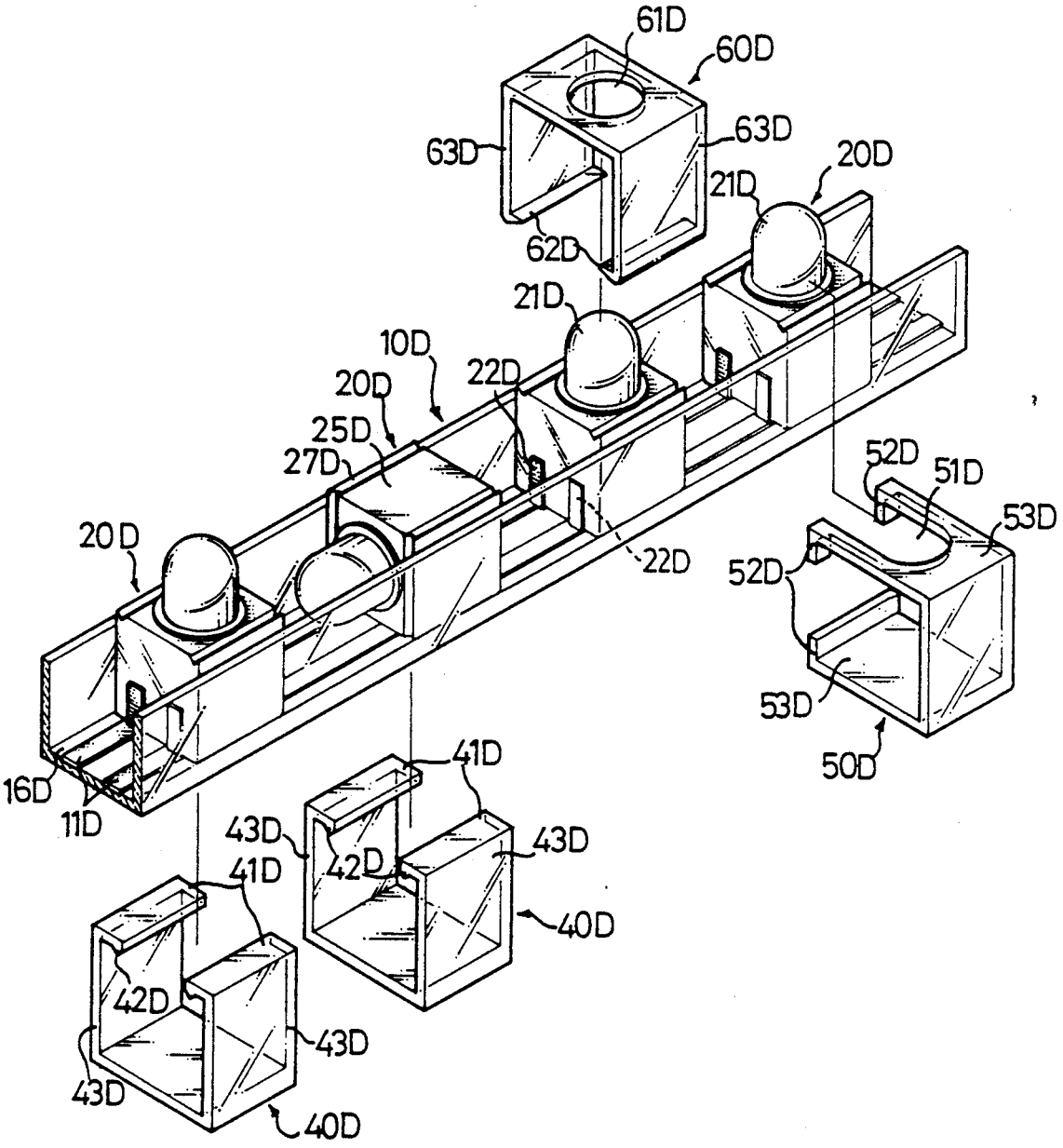
FIG. 9 shows a partial exploded view including fifth, sixth and seventh embodiments of the invention.

As shown in FIGS. 9 and 10, clips 40D can also be used for securing the horizontally-disposed light units 20D on the tube 10D. Also shown in the drawings is the sixth embodiment of the present invention, where the top of clip 60D is centrally provided with a hole 61D, and the lower ends of the sides 63D are each provided with a fastening edge 62D. Therefore, the clip 60D may secure the light unit 20D on the tube 10D as shown in FIG. 10. In FIGS. 9 and 10, the seventh embodiment of the present invention also is shown wherein a clip 50D is modified to have one side 53D provided with a recess 51D, so that when the clip 50D tends to secure the light unit 20D from a horizontal direction, the recess 51D may serve as an opening for the bulb 20D. Both ends of the two sides 53D are provided with an inward fastening edge 52D respectively which hold on the side of the tube 10D.

Figure 11:
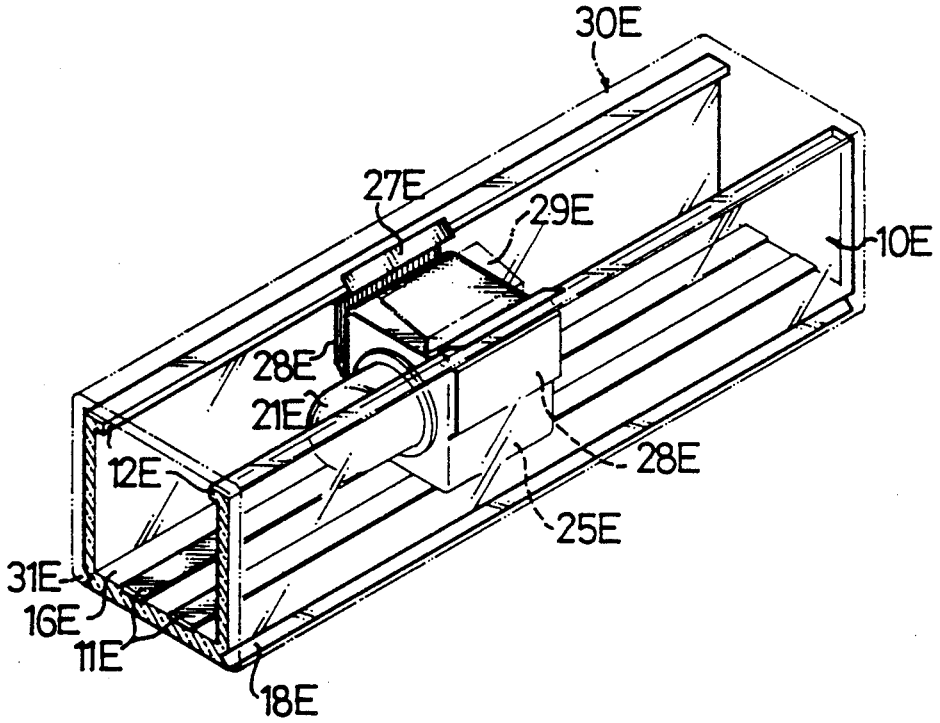
FIG. 11 shows an assembled view of an eighth embodiment of the invention.
Figure 12:
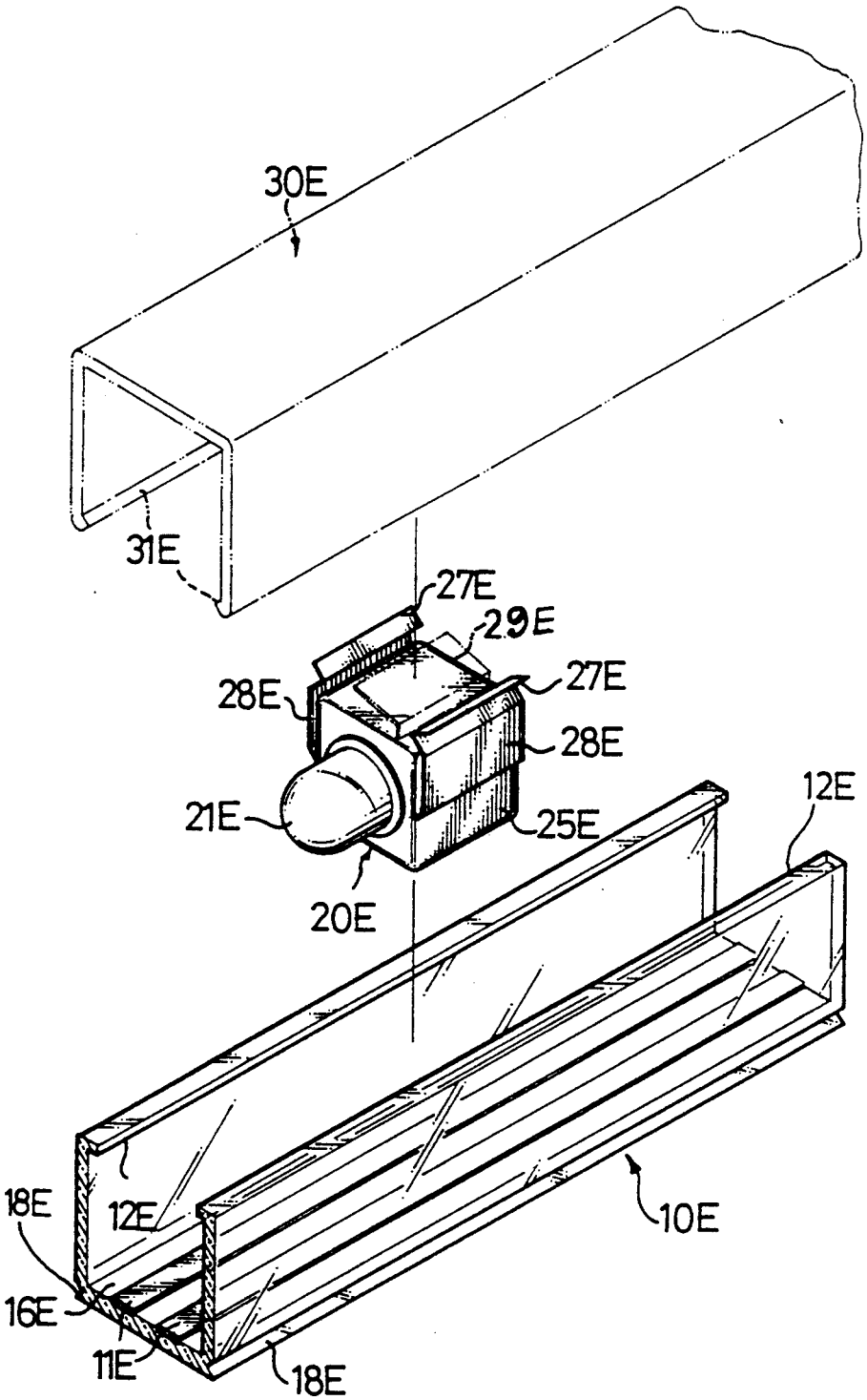
FIG. 12 shows an exploded view of the assembly of FIG. 11.
Figure 13:
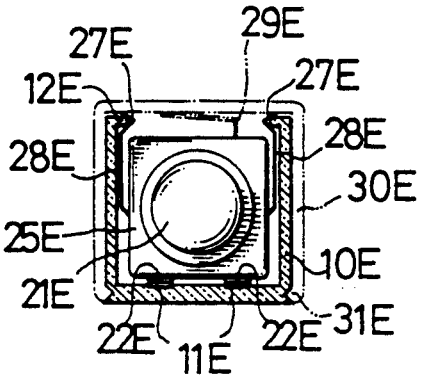
FIG. 13 shows a front view of FIG. 11.

Referring now to FIGS. 11, 12 and 13 which show the eighth embodiment of the present invention, a socket 25E is horizontally disposed in the tube 10E The socket 25E is provided longitudinally at each of its two sides with respective wings 28E extending over the top of the socket 25E. The top of each wing 28E is formed with a V-shaped wing hook 27E. Thus, when the light unit 20E is positioned in the tube 10E, the wing hook 27E may grasp the flanges 12E located at the top of the sides of the tube 10E, respectively. Furthermore, there may be provided a cover 30E with two sides thereof each provided with a fastening edge 31E at the ends. At the lower portion of the two sides of the tube 10E may be each correspondingly provided with a V-shaped groove 18E and, therefore, when the cover 30E covers the tube 10E, the fastening edge 31E will engage with the V-shaped groove 18E. In order to have a better contact between the contacts 22E of the light unit 20E and the conductor strips 11E inside the tube, a biasing member 29E may be added to socket 25E, thereby producing a force pressing against the light unit 20E when the cover 30E is attached to the tube 10E.

Figure 14:
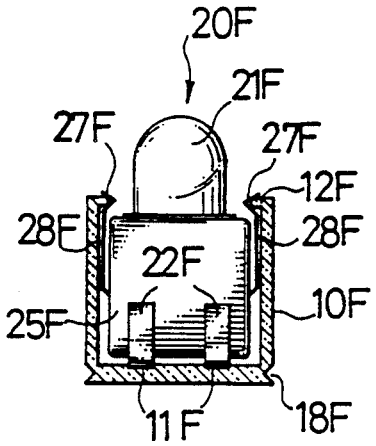
FIG. 14 shows a front view of a ninth embodiment of the invention.

FIG. 14 shows the ninth embodiment of the present invention, wherein the light unit 20F is disposed upright in the tube 10F and wherein both two sides of the socket 25F are each provided with a wing 28F and a wing hook 27F similar to those in the embodiments of FIGS.

11 to 13. In the present embodiment, the wings 28F and the wing hooks 27F engage with the flange 12F, thereby securing the light unit 20F in the tube 10F.

Figure 15:
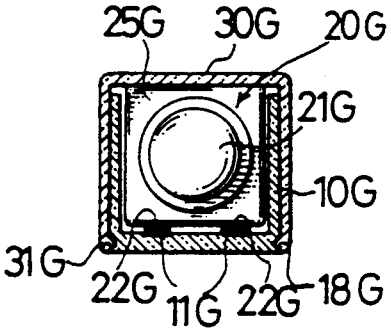
FIG. 15 shows a front view of a tenth embodiment of the invention.

FIG. 15 shows a tenth embodiment of the present invention, wherein the light units are horizontally disposed in the tube 10G, and a cover 30G is provided for holding the light units 20G therein. Both sides of the cover 30G are each also provided with a fastening edge 31G at the lower end, so that the fastening edges 31G may engage with the V-shaped grooves 18G at the lower ends of the sides of the tube 10G.

Figure 16:
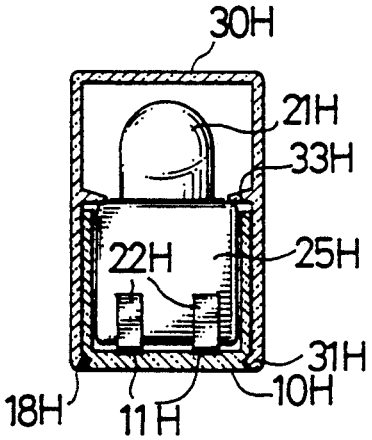
FIG. 16 shows a front view of an eleventh embodiment of the invention.

FIG. 16 shows an eleventh embodiment of the present invention, wherein the light unit is vertically disposed in the tube 10H. The cover 30H, at the central position and the lower end of the inner wall of the two sides, is provided with a flange 33H and a fastening edge 31H respectively for each side. The fastening edges 31H can engage with the V-shaped grooves 18H located at the lower ends of the sides of the tube 10H, while the flange 33H can press against the top of the socket 25H.

In view of the above, it is understood that the spirit of the present invention is to use a longitudinal tube, no matter what the configuration of its cross-section is, a plurality of light units each of which has a cross-section substantially conforming to that of the inside of the tube and can be loaded into the tube in an orderly fashion. Thus the purposes of making simple structural tube lights via mass production, and the resulting product thereof can be self-assembled by the consumers, are achieved. Because of the cooperation of the various structures for securing the light units in the tube, the work of mounting the light units is greatly enhanced and simplified.

Various modifications may be made and still fall within the scope of the present invention. For instance, in the embodiments shoWn in FIGS. 11, 12, 13 and 14, the conductor strips may be provided on the top edges of the tube, and the contacts be extended outward from inside of the socket so as to form a wing-configuration. These wing-configurational contacts may also be extended from the bottom of the socket (that is, the portion adjacent to the bottom of the tube) upward to above the top edge of the tube, so that the wing-configurational contacts may on the one hand secure the light units on the tube, and on the other hand accomplish a suitable electrical connection.

Nevertheless, the above-mentioned embodiments of the present invention are intended to describe examples of the invention rather than to limit the scope of the invention. Any modification or change that is still within the spirit of the present invention and equivalents should be considered falling within its scope.

What is claimed is:

1. A tube light comprising:

a length of translucent insulating tube having an internal cross-section of substantially constant configuration, continuous electrical conductor strips disposed in a spaced and substantially parallel relationship along the length of the tube, the conductor strips being adapted to be connected with an electrical power source, the tube having a continuous opening of the same width along one side of the tube; and a plurality of light units each having substantially the same size and general structure, and wherein each light unit has an external configuration substantially conforming to the internal cross-section of the tube to enable the light unit to be loaded into the tube, and each light unit being provided with a hole and contacts wherein the contacts have portions extending inside of the hole and outside of the light unit, the spacing of each contact portion extending outside of the light unit conforming to that of the conductor strips provided in the tube, and the spacing of each contact portion extending inside of the hole conforming to that of the bulb inserted into the hole.

2. The tube light according to claim 1, wherein the continuous opening at one side of the tube is defined by edges provided along the upper side of the tube, and opposing the edges are provided with V-shaped edges.

3. The tube light according to claim 1, wherein the tube further comprises a cover, the cover has a length and width conforming to those of the tube, and the bottom of the cover at internal sides is provided with V-shaped grooves which can engage with the V-shaped edges of the tube.

4. The tube light according to claim 1, wherein the light units comprises an insulating translucent socket of rectangular-parallelepiped configuration, a bulb, and a pair of contacts which can be in touch with the conductor strips of the tube.

5. The tube light according to claim 1, wherein the continuous conductor strips are provided at the bottom of the tube.

6. The tube light according to claim 1, wherein the continuous conductor strips are provided on the inside facing side walls of the tube.

7. The tube light according to claim 5, wherein a continuous protrusion is provided along the bottom of the tube and between the conductor strips.

8. The tube light according to claim 4, wherein adjacent sides of the socket are provided with communicating grooves.

9. The tube light according to claim 4, wherein the insulating socket is formed as a hollow rectangular parallelepiped, the upper side of the socket has an opening to accommodate a bulb having contacting ends, the two sides closely adjacent the upper side are provided with openings so as to enhance insertion and removal of the bulb, recesses are provided at the internal ends of the socket for holding the contacting ends of the bulb, and contacts are provided at the ends of the socket and extend inside of the recess and outside of the underneath of the socket.

10. The tube light according to claim 1, 2, 3, or 4, wherein the bulb of the light unit has an L-configuration, of which the illuminating portion is arranged to be disposed upwardly.

11. The tube light according to claim 1 or 4, wherein the top and its adjacent side are each provided with two parallel grooves, and further comprising a clip, the clip has two symmetrical sides corresponding to the width of the tube, the height of each side corresponds to the length of the side of the socket, the lower ends of the sides of the clip being each inwardly provided with a flange, and at the ends of the flanges being each provided with a fastening edge able to engage with the groove.

12. The tube light according to claim 1 or 4, further comprising a clip, wherein a hole allowing the bulb to pass through the clip is provided on the center of the top of the clip, the clip also has two symmetrical sides corresponding to the width of the tube, the height of each side corresponds to the length of side of the socket, and the lower ends of the sides of the clip being each inwardly provided with a flange so as to hold on the underneath of the tube.

13. The tube light according to claim 1 or 4, further comprising a clip, wherein the clip is provided with two symmetrical sides corresponding to the length of the sides of the socket, the length of the sides corresponds to the width of the tube, the ends of the sides each has a protruding fastening edge, and wherein a recess allowing the bulb to pass through is provided in one of the sides.

14. The tube light according to claim 1 or 4, wherein the light unit is disposed in the tube horizontally, a wing extends upward from each of the symmetrical sides of the tube, the wings extend over the sides of the tube, a wing hook is formed at the top of each wing, and wherein at the top of each of the two sides of the tube extends inwardly a flange, the wing hooks engage with the flanges.

15. The tube light according to claim 14, wherein each of the lower ends of the sides of the tube is provided with a groove, the upper side of the socket being provided with a bias member, and further comprising a cover, a fastening edge being extended from each of the lower ends of the sides of the cover, such that the fastening edges may engage with the grooves, and the cover may press against the bias member when it covers the tube.

16. The tube light according to claim 1 or 4, wherein the light unit is disposed in the tube horizontally, a groove provided at each of the lower ends of the sides of the tube, the upper side of the socket provided with a bias member, and further comprising a cover, a fastening edge extending from each of the lower ends of the sides of the cover, such that the fastening edges may engage with the grooves, and the cover may press against the bias when it covers the tube.

17. The tube light according to claim 1 or 4, wherein the light unit is disposed in the tube vertically, a wing extends upward from each of the symmetrical sides of the tube, the wings extend over the sides of the tube, a wing hook is formed at the top of the wing and wherein the top of each of the sides has an extending flange, and the wing hooks engage with the flanges.

18. The tube light according to claim 1 or 4, wherein each of the lower ends of the sides of the tube is provided with a groove, and further comprises a cover, the height of the cover corresponding to the height of the socket, and a fastening edge being inwardly extended from the lower ends of the sides of the tube so that when the cover presses against the socket the fastening edges may engage with the grooves.

19. The tube light according to claim 1 or 4, wherein each of the lower ends of the sides of the tube is provided with a groove and further comprising a cover, the height of the cover corresponding to the height of the light unit as it is vertically disposed, each of the lower ends of the sides of the cover having an inwardly extended fastening edge, and the inner wall of the sides of the cover at the central portion corresponding to the height of the socket has a flange extending therefrom so that when the cover presses against the grooves the flange may press against the top of the socket.

20. The tube light according to claim 1 or 4, wherein the conductor strips are provided on the top edges of the tube, and the contacts of light units extend outward to form a wing-like configuration, and upward to above the top edges of the tube so as to secure the light units on the tube.

21. A tube light comprising a tube in the form of a length of translucent material having an internal cross-section of substantially constant shape, and having a continuous opening along one side of the tube, and at least a pair of continuous electrical conductors disposed in a spaced and substantially parallel relationship along the length of the inside of the tube and being adapted to be connected with an electrical power source, and a plurality of light units each comprising a socket, light source, and electrical contacts interconnecting the light source with the exterior of the socket, each socket having an external configuration substantially conforming to the internal cross-section of the tube to enable the socket to be loaded into the tube, and each socket having a hole for receiving the light source with the electrical contacts electrically communicating between the light source and the exterior of the socket, said electrical contacts at the exterior of the socket being disposed to engage the electrical conductors in the tube.

22. A tube light as in claim 21 wherein each light source comprises a light bulb extending from the hole in the socket and through the opening in the tube.

23. A light unit as in claim 21 wherein each light source comprises a light bulb having an L-shape with one leg in said hole in said socket and a second light emitting leg extending at substantially ninety degrees therefrom and through said opening in said tube.

24. A light unit as in claim 21 wherein each socket has a top, bottom and four sides, the hole in said socket extends into the socket for receiving the light source in the form of a light bulb, and the electrical contacts extend through the bottom of the socket into the hole and extend from the bottom of the socket for engaging said electrical conductors of the tube.

25. A light unit as in claim 21 wherein each socket has a top, bottom and four sides, the hole in said socket extends into the socket for receiving the light source in the form of a light bulb, and the electrical contacts extend through the sides of the socket into the hole and extend from the sides of the socket for engaging said electrical conductors of the tube.

26. A light unit as in claim 21 wherein each socket has an internal cavity having ends provided with the electrical contacts, and said light source comprises a light bulb having conductors on the ends thereof for engaging the said ends of the socket and electrical contacts thereon.

27. A light unit as in claim 21 wherein each socket comprises an upper surface into which said hole extends, said upper surface having grooves at edges thereof for facilitating retention of the socket in the tube.

28. A light unit as in claim 21 wherein wing members engage sides of the socket for facilitating retention of the socket in a tube.

* * * * *